US006113522A

United States Patent [19]

Fontenot et al.

[11] Patent Number: 6,113,522

[45] Date of Patent: Sep. 5, 2000

[54] EXERCISE APPARATUS

[75] Inventors: Anthony Fontenot, Mamou, La.; Robert N. Montgomery, 109 Brownlee Ave., Broussard, La. 70518

[73] Assignee: Robert N. Montgomery, Broussard, La.

[21] Appl. No.: 08/999,656

[22] Filed: Nov. 28, 1997

Related U.S. Application Data

[63] Continuation of application No. 08/395,300, Feb. 27, 1995, abandoned, which is a continuation-in-part of application No. 08/067,701, May 26, 1993, abandoned.

[51] Int. Cl.[7] ..... A63B 21/00

[52] U.S. Cl. ..... 482/111; 482/112; 482/117; 482/121; 482/130; 482/134

[58] Field of Search ..... 482/72, 92, 111–113, 482/117, 121–123, 127, 129, 130, 133, 134, 136–139

[56] References Cited

U.S. PATENT DOCUMENTS

| | | | |
|---|---|---|---|
| 1,707,791 | 4/1929 | Anderson . | |
| 2,190,895 | 2/1940 | Turpin . | |
| 3,640,525 | 2/1972 | Proctor . | |
| 3,731,921 | 5/1973 | Andrews, Jr. . | |
| 3,981,500 | 9/1976 | Ryan . | |
| 4,050,449 | 9/1977 | Castellana | 482/113 X |
| 4,063,727 | 12/1977 | Hall | 482/123 X |
| 4,385,760 | 5/1983 | Mattox et al. . | |
| 4,471,957 | 9/1984 | Engalitcheff, Jr. . | |
| 4,494,662 | 1/1985 | Clymer | 482/130 |
| 4,563,004 | 1/1986 | Mattox . | |
| 4,620,704 | 11/1986 | Shifferaw | 482/130 |
| 4,632,393 | 12/1986 | Van Noord . | |
| 4,900,019 | 2/1990 | Shamir | 482/123 |
| 5,100,131 | 3/1992 | Fong | 482/112 |
| 5,123,886 | 6/1992 | Cook | 482/103 X |
| 5,125,882 | 6/1992 | La Mothe et al. . | |

FOREIGN PATENT DOCUMENTS

| | | | |
|---|---|---|---|
| 1556694 | 4/1990 | U.S.S.R. | 482/121 |
| 2074034 | 10/1981 | United Kingdom | 482/111 |

OTHER PUBLICATIONS

Fitness Dynamics Brochure.
Body by Jake AB & Back Plus.
Roto–Crunch by Quantum Fitness Corp.

*Primary Examiner*—John Mulcahy
*Attorney, Agent, or Firm*—Robert N. Montgomery

[57] ABSTRACT

An exercise apparatus for toning the mid-section and lower portion of the body, especially helpful for handicapped individuals who have marginal or only functional use of their lower extremities on an involuntary basis whereby a physically able person or a physically challenged person manipulates a pendulum bar, freely suspended from a semi-flexible member in a quarter circular oblique movement, while strapped to the apparatus in a seated position, and whereas the flexibility of the flexible member is predetermined by design or controlled hydraulically by the user.

38 Claims, 15 Drawing Sheets

EXERCISE APPARATUS

This application is a continuation, of application Ser. No. 08/395,300, filed Feb. 27, 1995, now abandoned which is a continuation-in-part, of application Ser. No. 08/067,701 filed May 26, 1993 and now abandoned.

BACKGROUND OF THE INVENTION

1. Field of the Invention

The apparatus of the present invention relates to exercise equipment. More particularly, the present invention relates to an exercise apparatus having a polymeric member as the principle resistance element.

2. General Background

Exercising has become regarded as one of the most important aspects in maintaining one's health. In fact, the exercise industry has become a multi-million dollar industry with the arrival of exercise equipment which utilizes cables and dead weights, stretchable elastic units, or hydraulic cylinders for their resistive members. With these types of systems, one is able to have a complete exercise regimen in ones own home, without having to be a member of a club or the like. However, one of the areas where exercise is important is with people who have been injured or are physically handicapped or challenged. Such individuals require exercise which will enable them to maintain their conditioning in a way more suited to their particular needs. One such group would be individuals who have lost the use of their lower limbs, such as paraplegics. It is critical that such individuals have access to exercise equipment suitable to meet their special needs. Due to the fact that the physically handicapped are unable to move around and expend sufficient energy, weight gain becomes a major problem. In addition, because of their impairment, they are unable oftentimes to exercise on standard equipment. Other special groups include pregnant women and women who have recently given birth and need to reshape their bodies.

There is an ongoing need for an exercise system where paraplegics or other special groups may be supported in such a manner that he or she is able to conduct various upper body exercise routines while in the seated position, which would require a minimum of lower body movement, and would result in complete toning of the torso and upper body muscles, and as a result, provide significant weight loss to the user. However, in the normal course of physical body toning, the abdominal region is always a problem area and requires special attention. Improper stretching of the abdominal muscles can result in permanent damage. Therefore, even for healthy individuals, it is essential that such exercise be done under controlled conditions. Too much resistance such as when doing sit-ups, can result in muscle bulk in place of toning.

Several patents have been identified as addressing the subject of exercise equipment in general and those designed to accommodate the physically handicapped. These are listed and identified in the prior art statement which will be made a part of the record of this case.

Other objects of the invention will be obvious to those skilled in the art from the following description of the invention.

SUMMARY OF THE PRESENT INVENTION

The direct manipulation by distortion of a polymeric member has been found to be beneficial in exercise routines by both the physically able or a physically challenged individual. Therapeutic exercises are prescribed to fit the needs of individuals according to there ability. Therefore, weights which snap back in free fall or elastic bands which have progressive resistance and snap back when released tend to be ineffective for use with the disabled such as burn victims or paraplegics. Exercise of the neck, shoulders, back and abdominal muscles is particularly sensitive for the physically challenged and the able bodied alike. The present invention solves the problem by providing various apparatus which rely on a single polymeric member as the principle resistance member. The direct manipulation through distortion of this member, allowing both torque and bending to occur simultaneously, provides the user with freedom of movement in all planes. The physically challenged individual can thus move in the planes which do not produce pain and to the limits desired.

In one embodiment the polymeric member is manipulated by providing a pendulum bar which can be shaped in almost any configuration, freely supported by the polymeric member which by the nature of the material and its construction, offers the user a predetermined resistive force in all planes including applied torque. The invention may be equipped with a method for further control of the resistive member by the use of a variable tension ball and socket joint which the user manipulates during exercise. Another embodiment relies on gas or fluidics for varying the rigidity of the flexible member. With this innovative apparatus, the user manipulates the pendulum bar and its dynamic resistive force member while in a seated position. Handicapped individuals such as paraplegics, may be securely strapped to the seat portion of the apparatus thus becoming an intricate part of the apparatus.

The direct manipulation of such a polymeric member by users having such freedom is highly preferred over the other exercise equipment which depends on free weights and cables, hydraulic cylinders and elastic bands which have only one or two degrees of freedom. However, some more recent exercise units have employed a flexible member, such flexible member units still rely on cables to provide freedom of movement in all planes including the oblique. Dependence on cables which can break or snap back causing injury to the user or damage the equipment is a serious problem.

A medical or therapeutic model disclosed herein provides the user with a base frame having non-projecting legs for supporting the device on a flat surface so as not to interfere with a wheel chair and further comprises an extra heavy, cushioned seat portion attached to the base frame to support the user; a hand rail which allows for easy access from a wheel chair; a strap means for securing the user's body and legs to the frame; an adjustable vertical post member extending upwards from behind the seat; an elongated polymeric member attached to the vertical post member extending forward; and a pendulum bar attached to one end of the polymeric member and freely suspended above and behind the user. It should be noted that the vertical post member is infinitely positionable by the user between a first retracted position and a second extended position towards the user and whereas such movement is dampened by variable hydraulic shocks which only serves to ensure a smooth return of the vertical post to its retracted position. To use the apparatus for exercise of the abdominal muscles, the afore mentioned pendulum bar, which is suspended above and somewhat behind the users head, is grasped by the user while in a secure, seated position on the apparatus and is freely manipulated during the exercise routine in all planes including the oblique. Resistance is provided by the polymeric member or in conjunction with a ball and socket joint and/or in concert with a hydraulic force unit varying the rigidity of the polymeric member. This arrangement completes the loop, making the user an integral part of the machine. A unique, springable adjustable, rolled back rest assembly which fits the user's spinal curve may also be provided for the user to rest against during exercise. The exercise system requires no dead weights or springs or the like to conduct the exercise routine.

It has now been established that overall body toning can be achieved in a comfortable, relaxed manner. The direct manipulation of a polymeric member in multiple planes as disclosed in the instant application, allows users to employ the well accepted exercise routine concept and practice of a "Constant Bar Assisted Quarter Circular Movement" in association with a "Resistance Pendulum Principle." This concept has been practiced by body builders for some years. Such practices include the use of a free bar in performing "Trunk Twist" exercises in the upright or bent forward position whereby the bar is employed across the back of the neck and shoulders and grasped with each hand near its ends. With the hips stabilized, in this case by the seat belt of the apparatus, the user rotates the bar by twisting at the waist as far as possible to the left and immediately moving in a similar fashion to the right twisting the waist smoothly. The user continues this back and forth twisting action concentrating the effort into the side muscles for two or three sets of 15–20 repetitions each. In the bent forward position, the user repeats the previous exercise routine to further exercise the back muscles while pulling the leg tendons. This is especially effected when seated and when incapacitated below the waist. A third exercise routine called the seated side bends calls for the user to grasp the bar as before and rotate the bar in pendulum motion bringing the elbow as near to the hip as possible. Alternating this left and right rotational movement nonstop for four sets of 15–20 repetitions each causes a hip rolling motion which directly affects the oblique, leg, hip shoulder and stomach muscles. The effectiveness of the bar exercise is super enhanced by stabilizing the users legs and offering a preset or variable resistance to the bar itself. The instant apparatus as disclosed herein takes advantage of what body builders have been teaching for years. Twisting and bent oblique exercises develop a firm, defined, tight waist line. This is best achieved without use of weights which often tend to thicken the waist. However, resistance reduces the time necessary to achieve the desired result and with the disclosed apparatus a more natural body movement with oblique exercises can be achieved.

The basic principle of the apparatus also allows those with lower body disfunction to exercise their lower extremities on an involuntary basis due to the upper body movement. This involuntary movement forces the lower extremities to contract and elongate muscles, much the same as someone falling, reaches out for involuntary stabilization. Therefore, the seated position of the body accompanied by the proscribed routines result in a compound, friction yielding, concentrated heat thereby resulting in extreme calorie burning in the mid-body area. These coincidental friction points and the seated weight of the user's body, affects several areas of the body heretofore believed to be the last affected areas in weight loss. It is believed that with proper diet and proper use of the instant invention, a phenomenal weight loss can be achieved along with the concave curving of the oblique muscle groups in the stomach, mid-riff area, buttocks, lower back and hip areas.

Several embodiments are disclosed utilizing the polymeric concept which provides for abdominal exercise using the above principle. However, many other types of exercise routines using different concepts may also be accomplished through the use of direct manipulation of a polymeric member especially when the rigidity of the polymeric member can be varied.

It is an object of the present invention to provide an exercise apparatus which does not rely on weights, pulleys, and stretchable members such as springs or the like, to perform various exercise routines such as those described.

It is a further object of the present invention to provide an exercise apparatus which enables the physically handicapped, such as paraplegics or others who wish to adhere to the theory of spot reduction, to undertake upper body exercise routines.

It is still a further object of the instant invention to provide an apparatus which uses a pendulum bar freely suspended from a flexible member so that the user may be in the seated position, strapped to the exercise chair and thereby pulling against his own weight.

It is still a further object of the present invention to provide a simple exercise apparatus, for a paraplegic or other physically challenged person to use, which does not rely on heavy weights, cables or elastic bands and still results in significant upper body muscle tone and spot weight loss.

It is a further object of the present invention to provide an exercise apparatus where a physically able person or a physically challenged person manipulates a pendulum bar either freely suspended from a flexible member, or in combination with a ball and socket joint whereby different amounts of force can be applied to the joint to act as a resistor to the free movement of the bar during exercise.

It is still a further object of the present invention to provide an exercise apparatus whereby the pendulum bar is supported by a unitized, polymeric flexible member having a method of varying the degree of rigidity or flexibility.

It is a further object of the present invention to provide an exercise apparatus for overall body toning in a comfortable, relaxed manner for the overweight, elderly or physically impaired individuals who may be seeking body tone.

Still a further object of the present invention is to provide an exercise machine which will tone the lower body when the user only has functional use of his/her lower extremities on an involuntary basis due to the movement of the upper body.

It is also an object of the present invention to provide a safe and total upper body development apparatus which will exercise the following muscle groups, with proscribed routines, while in the seated position; side bends for trimming the obliques, waistline and mid-section, using the serratus anterior, rectus abdominis, obliquus externus abdominis, deltoideus, and latissimus dorsi. Bending trunk twist to between 20 to 25 degrees forward trims inward curving of the oblique sides, mid-section, waist line, stomach, lower back, buttocks, thighs and hips by exercising the gastrocnemius, soleus, rectus femoris, vastus medialis, tibialis anterior, extensor digitorum longus, intercostales, spinalis thoracis, longissimus thoracis, lliocostalis lumborum, teres major latissimus dorsi, gluteus medius, and the gluteus maximus.

A further object of the instant disclosure is to illustrate the concept of direct manipulation through distortion in multiple planes of a polymeric member as an effective exercise resistive member.

BRIEF DESCRIPTION OF THE DRAWINGS

For a further understanding of the nature and objects of the present invention, reference should be had to the following detailed description taken in conjunction with the accompanying drawings, in which, like parts are given like reference numerals, and wherein.

DETAILED DESCRIPTION OF THE PREFERRED EMBODIMENT

Figure 1:
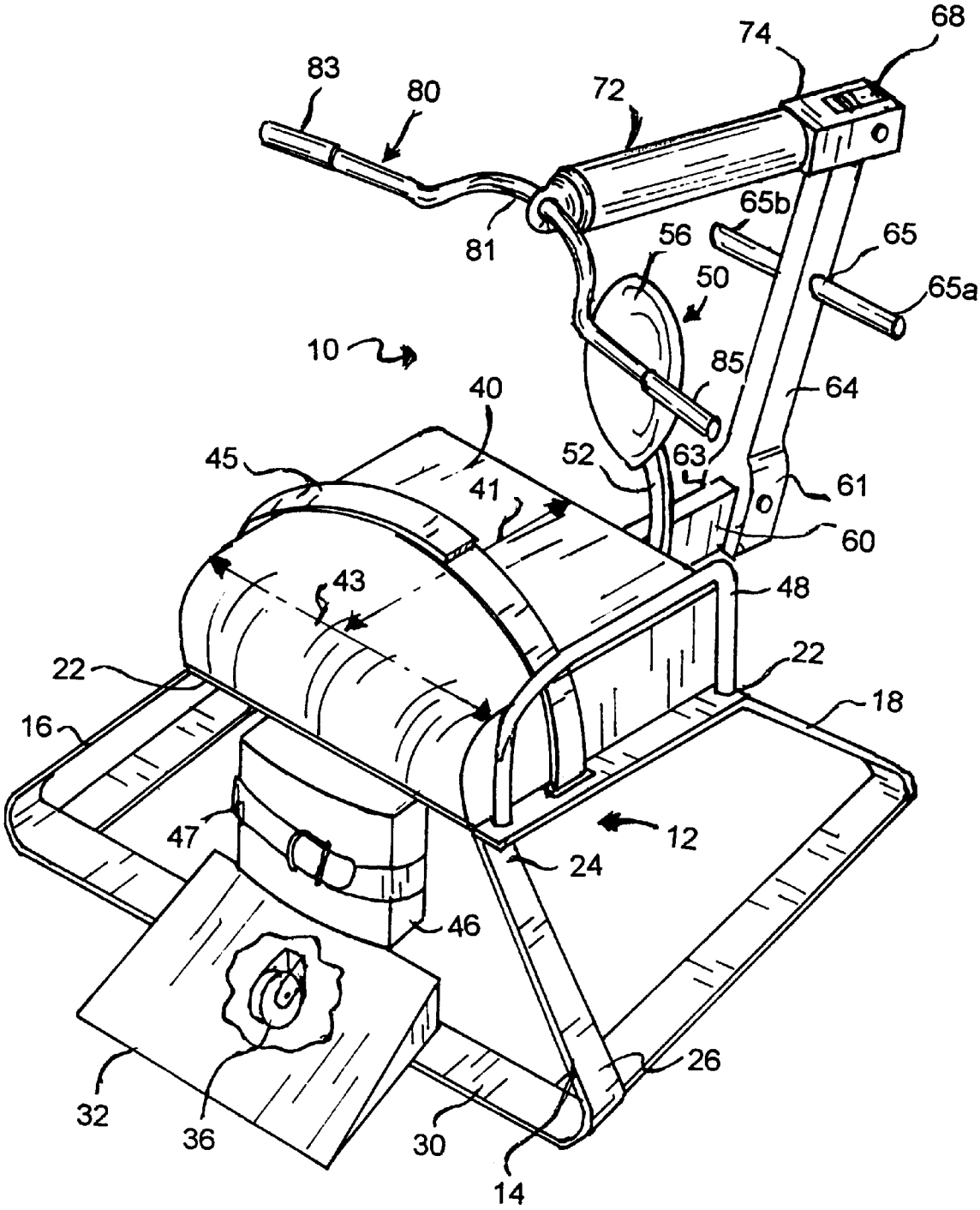
FIG. 1 illustrates an overall view of the preferred embodiment of the apparatus of the present invention.
Figure 8:
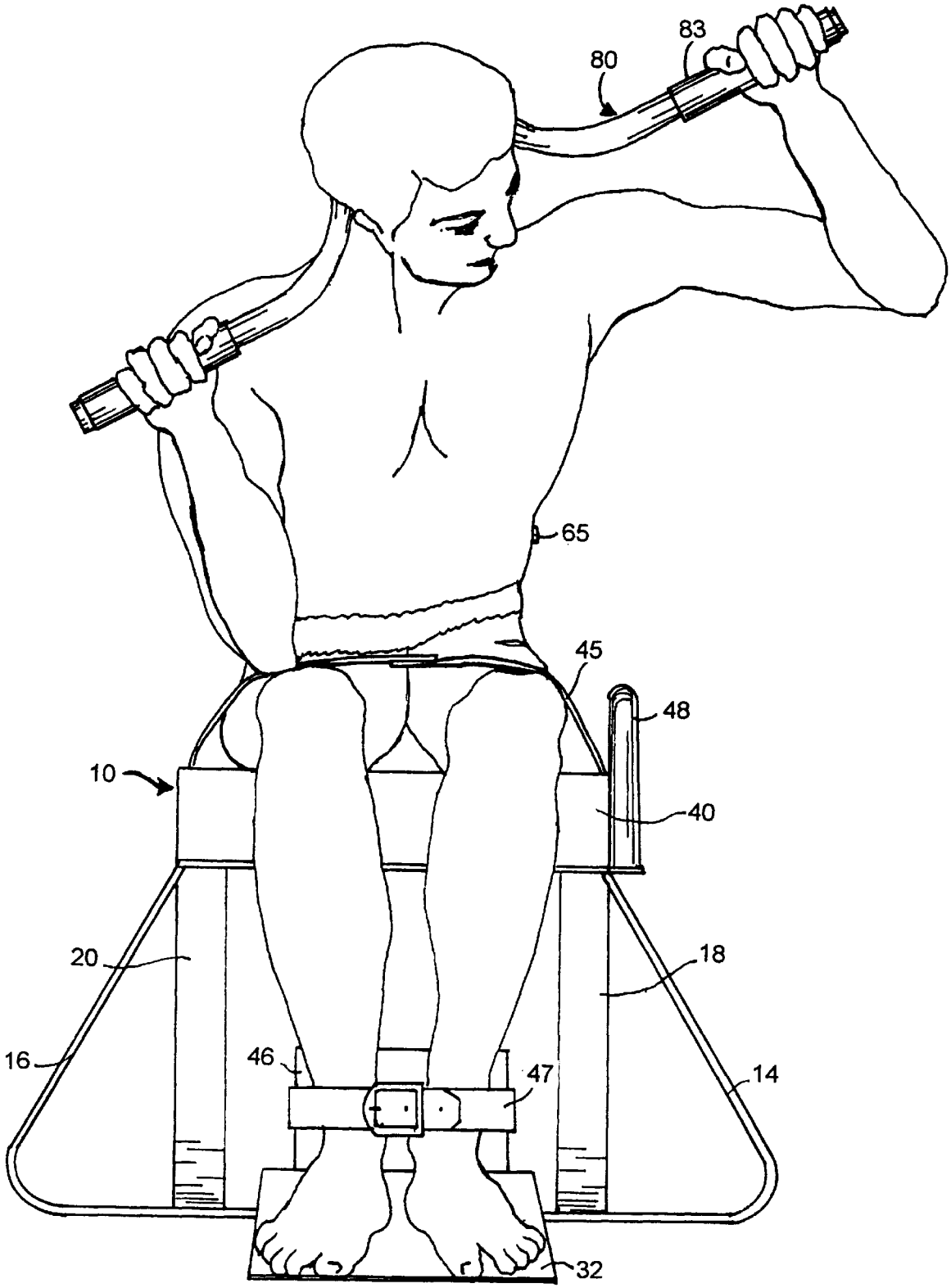
FIG. 8 illustrates a front elevation view of the present invention showing rotational ability of the pendulum bar about the central axis of the flexible member.
Figure 9:
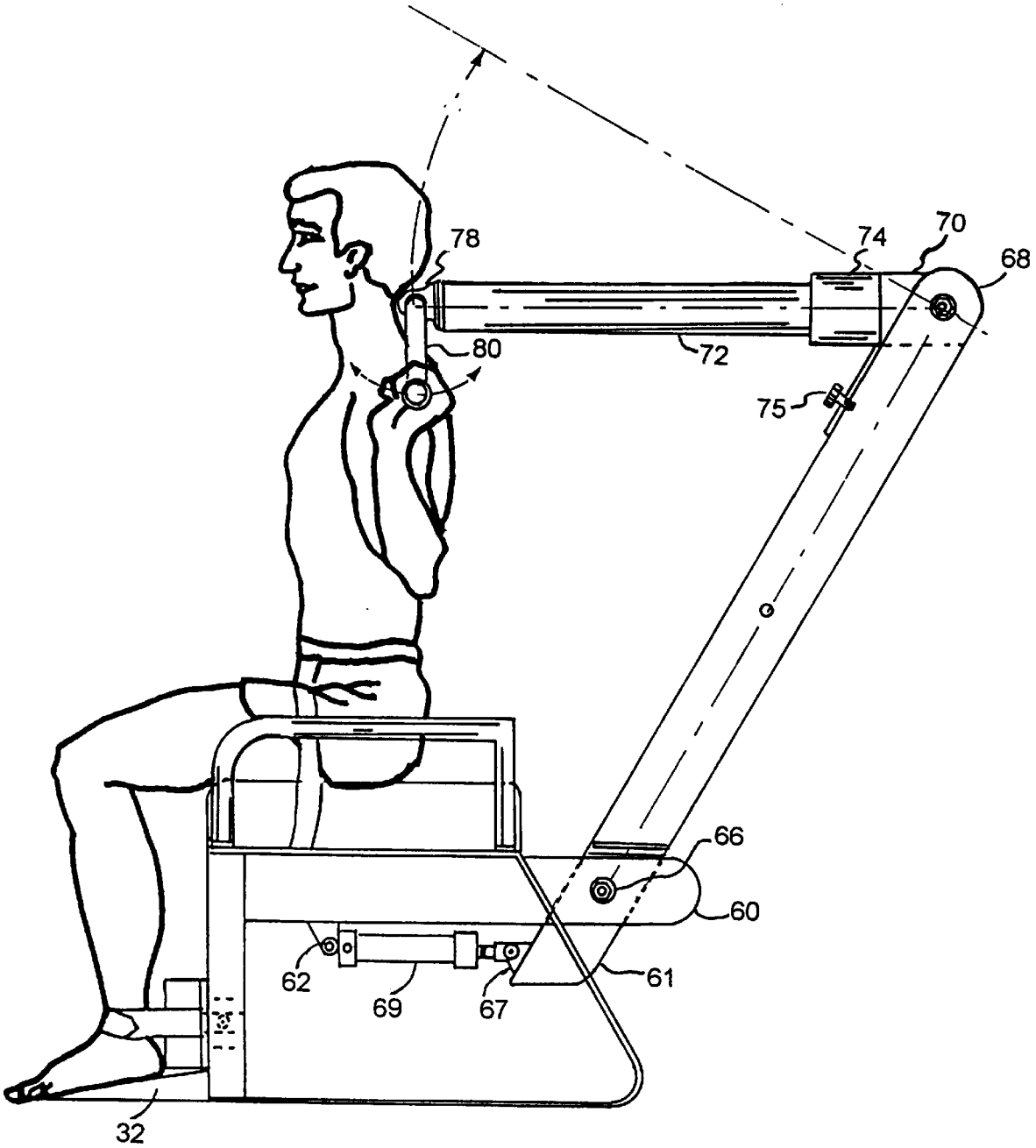
FIG. 9 illustrates a side elevation view of the present invention showing the proper positioning of the user, the flexible member, its ability to be set at angles above the head of the user, the rotational ability of the vertical support member and its relation to the hydraulic resistive means.

FIGS. 1, 8 & 9 illustrate the preferred embodiment of the exercise apparatus of the present invention by the numeral 10. As illustrated in the figures, the apparatus 10 comprises a base frame portion 12 formed by front legs 14,16 and a pair of rear legs 18,20. The front and rear legs support a lower, horizontally positioned frame member 60 therebetween. The front legs 14,16 are angled out from their horizontal upper ends 24, so that the lower ends 26 of the leg members 14, 16 provide a stable, broad based frame portion for resting on the floor . As illustrated, there is a bar member 30 spanning between the lower ends 26 of the front legs, with an angular foot plate 32 resting on the bar member 30 and slightly tilted forward for the user to rest his/her feet thereupon during exercising.

A pivotal wheel 36 may be added to the underside of foot plate 32 to allow the base frame to be move more readily.

Figure 4:
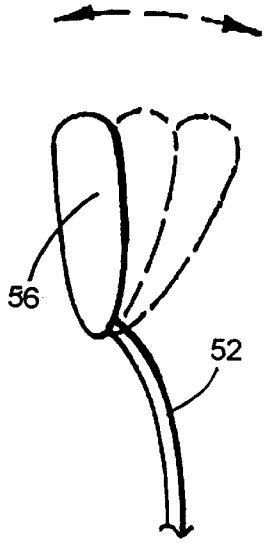
FIG. 4 illustrates a partial view of the adjustable back rest assembly for the present invention.
Figure 3:
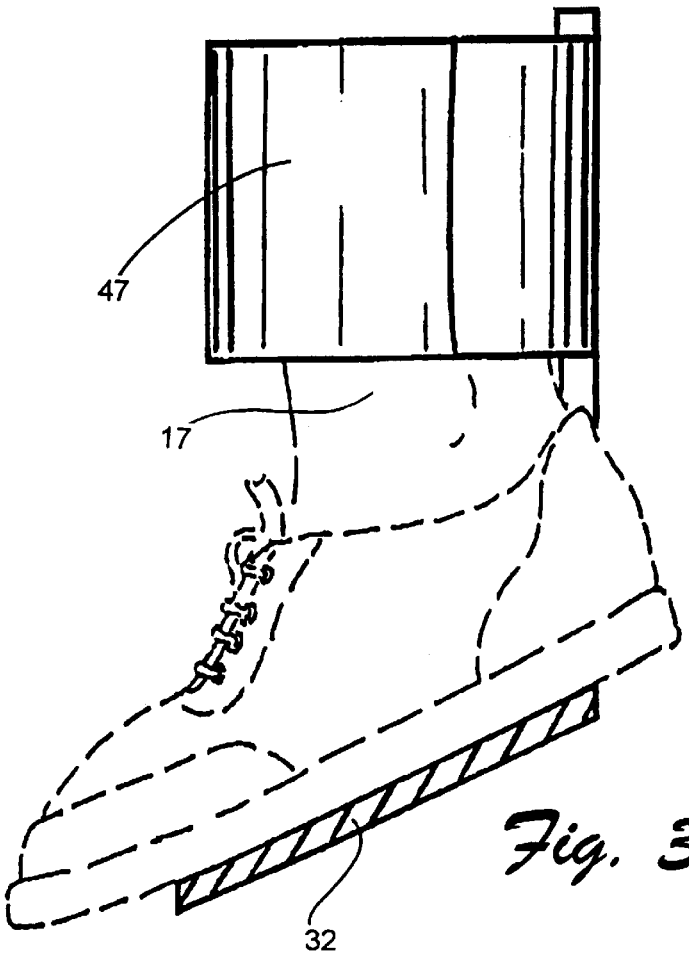
FIG. 3 illustrates a partial view of the ankle strap and foot plate members of the present invention.
Figure 11:
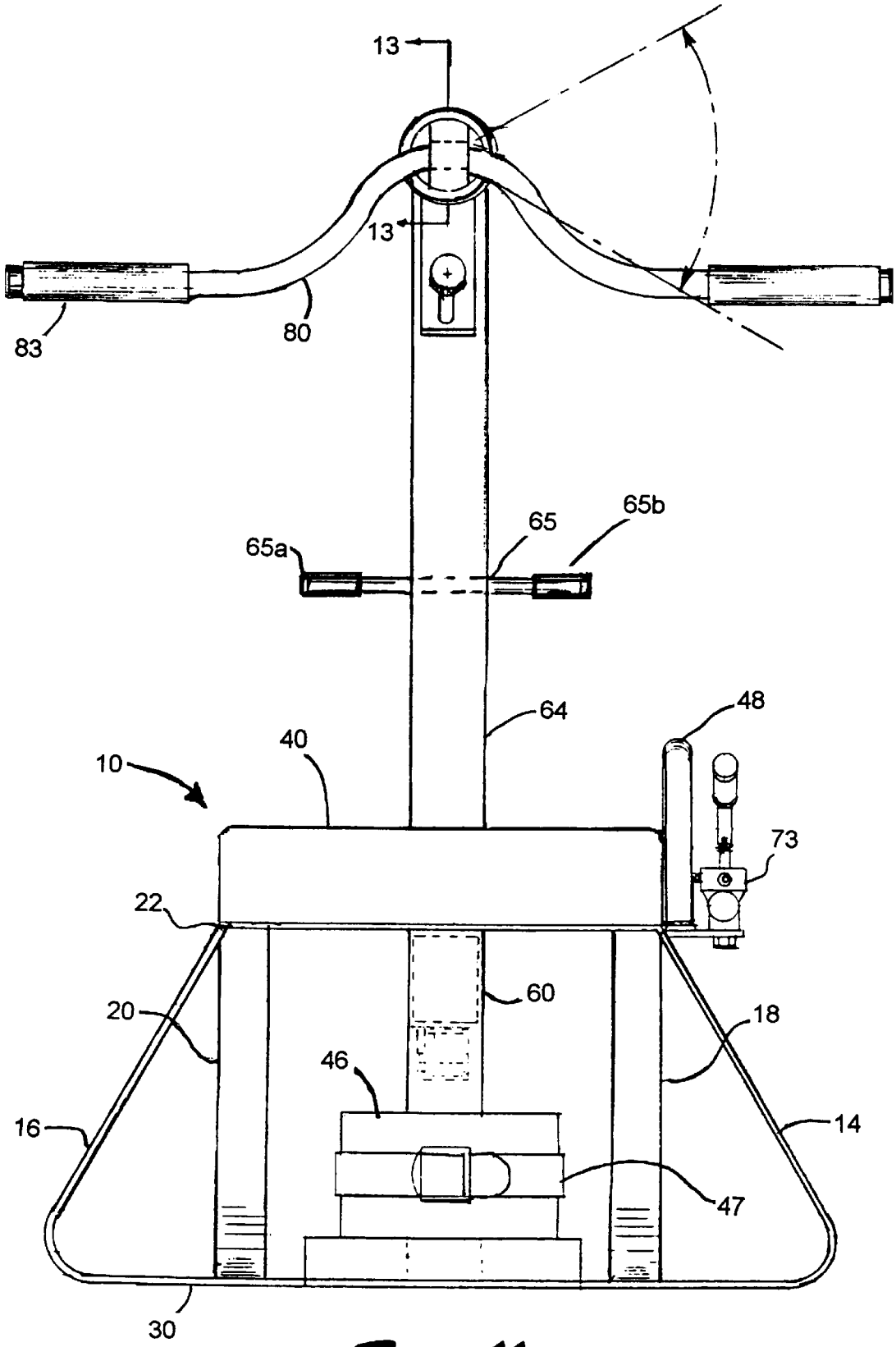
FIG. 11 illustrates a partial side elevation view showing the optional hydraulic hand pump.

Turning now to other structural features of the apparatus, reference is made to FIGS. 1 and 4. As illustrated, the frame member 60, supported by the front legs 14, 16, cross members 22, and rear legs 18, 20, serves as a means for supporting a cushioned seat portion 40 which is designed to have a length 41 and a broad width 43 sufficent to support, with comfort and stability, a paraplegic sitting thereupon and at a height which further assists a handicapped user in transferring from a wheelchair. As seen, the cushioned seat 40 also provides a seat belt 45 which would strap across and over the legs of the user so that he/she is firmly positioned thereupon and thereby becomes an integral part of the apparatus. There is provided a left handle bar 48 to assist the handicapped user in transferring from a wheelchair and to help support the person while exercising. As best seen in FIGS. 9 and 11, there would also be provided a calf muscle pad 46 and ankle belt 47 adjustably mounted and located mid-way between the front legs 14, 16 so that the ankles 17 of the user may be comfortably strapped down securely during the exercise routines. Along the horizontal length of the frame member 60, there is provided a back rest assembly 50. The assembly includes a back rest support member 52, the lower end of which is adjustably mounted to the frame member 60, and whereas the upper end supports a padded back rest portion 56. As illustrated, the back rest portion 56 comprises an elongated portion of padded material which supports the middle of the user's back, so as not to interfere with the movement of the pendulum bar 80 during exercise. The back rest portion 56 is adjustable and springable, as seen in phantom view in FIG. 4, so as to make the optimum contact with the back of the user, depending on the exercise.

Further as seen in FIG. 9, there is provided a rear, horizontally disposed support member 60 extending rearward from under the seat 40, attached to cross members 22 and the base frame portion 12. Rear support member 60 provides lower pivotal support for the lower forked ends 61, 63 of a vertical post member 64, which would extend upward to a length above the head of the user. The vertical post member 64 would further support a fixed bar 65 along its length. The bar 65 could include two handgrip portions 65A, 65B, so a person seated in the reverse position facing the vertical post member 64 may choose to grip these portions 65A, 65B as a means for biceps curling exercises.

Further, the vertical post member 64, being pivotal about a pivot pin 66 with the frame member 60 is restricted or dampened in its movement by a biased, closed loop gas or hydraulic resistive cylinder 69 which may be adjusted to control the amount of resistance or speed of retraction desired by the user. The resistive cylinder 69 is pivotal at each end, mounted at one end to the base frame member 60 via a rear cylinder mount 62 and at its opposite end to the lower end of the vertical post member 64 via a front cylinder mount 67.

Figure 2:
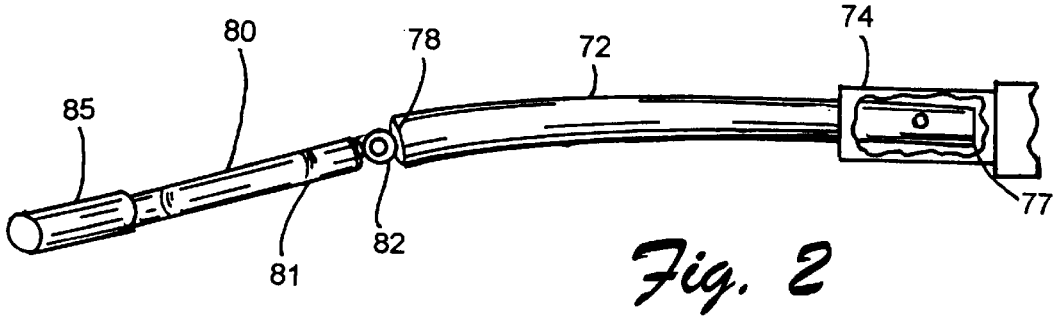
FIG. 2 illustrates a partial side view of the pendulum bar with a ball and socket joint affixed to the flexible member housed within the horizonal support member in the present invention.
Figure 10:
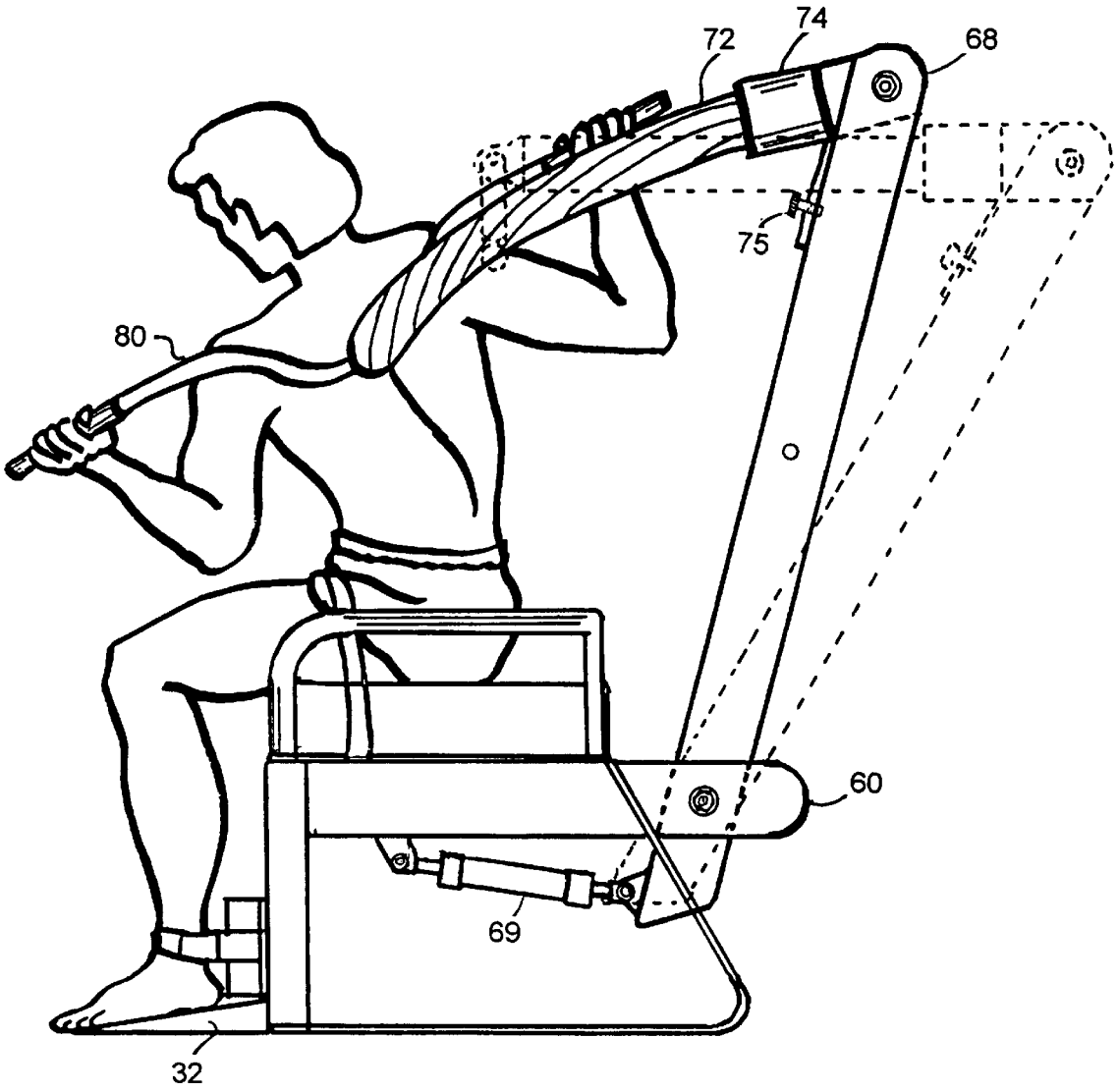
FIG. 10 illustrates the pivoting ability of the vertical support member and the torquing of the flexible member when the user performs oblique exercises.

Although a resistive cylinder 69 can be mounted above or below the horizontal member 60, the lower mounting is preferred in order to protect the cylinder. As illustrated in FIGS. 1, 9 & 10, the vertical post member 64 is tilted slightly to the rear of vertical; and its upper end 68 terminates in a pivotal connection with the containment housing 74, which functions to house a portion of the principal exercise means. In one embodiment this means comprises a length of flexible material such as a polymeric member as seen in FIG. 2. Its first end 77 is secured to the containment housing 74, and the opposite end 78 terminates at the ball joint 82 which has flexibility in all planes as well as partial rotation when torque is applied. As illustrated, the housing 74 in the preferred embodiment, could also be adjusted to an angle above the horizontal by adjustable stop 75, thereby, cantilevering the flexible member 72 above the head of the user seen as being connectedly engaged to the second principal portion of the exercise means. This portion would comprise a pendulum bar 80 supported either with or without the ball and socket joint 82 as illustrated in FIG. 1.

When performing the exercise routine, the user pulls and rotates the pendulum bar 80 against the resistance or the ball joint 82, and the natural resistance of the flexible member 72 in association with resistance offered by the vertical post member resistance cylinder 69.

The user should position the pendulum bar 80 above and slightly behind the head of the user for ease in manipulating the bar 80 during the exercise routine. This places the upper body at approximately 25 degrees forward when grasping the pendulum bar 80. The vertical post member 64 is automatically returned to its retracted position by the spring return capability of the shock cylinder 69. It is possible, however, to use various configurations for the pendulum bar 80. For instance, a bar can be provided which has handles such as that shown in FIG. 15 whereby the user can grip the handles in front of him in a more natural manner and still manipulate the flexible member in direct manner during abdominal exercise routines.

For purposes of structure, the flexible member 72 could be a resilient, semi-flexible material such as urethane. In either case the flexible member 72 of the preferred embodiment should be sufficiently flexible in all planes, including the oblique, when manipulated by the pendulum bar 80, yet be rigid enough to offer resistance to torque in the positions illustrated in FIGS. 8–10.

In addition, the shape of the pendulum bar 80 is important in that it includes an arcuate neck support portion 81, positionable on the user's shoulders and a pair of hand grip portions 83, 85 extending outward therefrom at an angle, so the user, rather than having to reach behind his shoulders to grab the grip portions 83, 85, would have the grip portions in a position in front of the shoulders for easy grasping.

Figure 5:
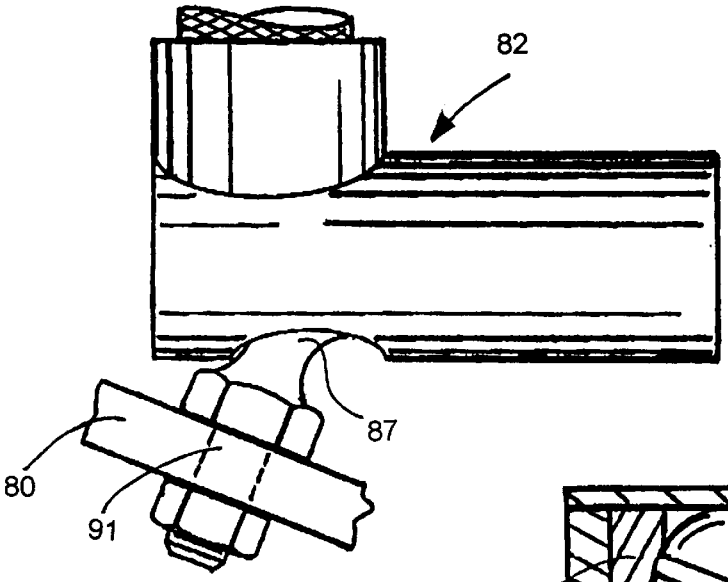
FIGS. 5–7 illustrate views of the optional ball and socket joint connection between the flexible member and the pendulum bar of the present invention.
Figure 6:
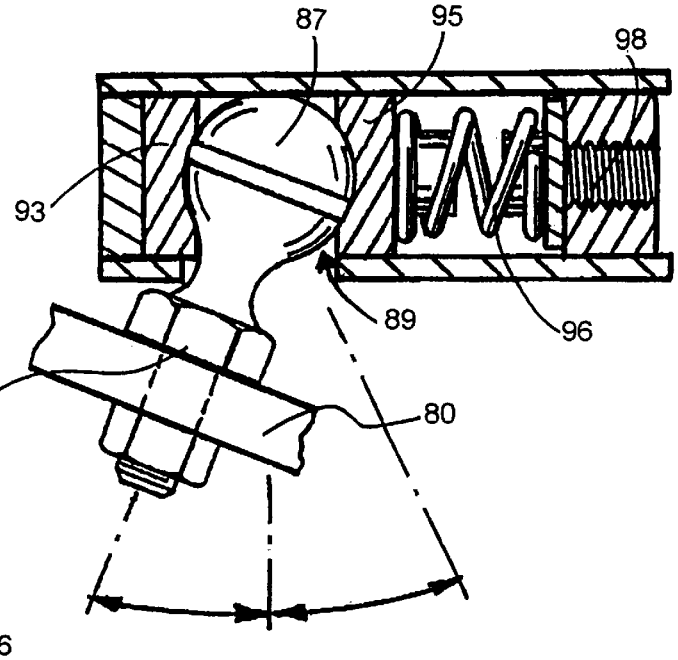
Figure 7:
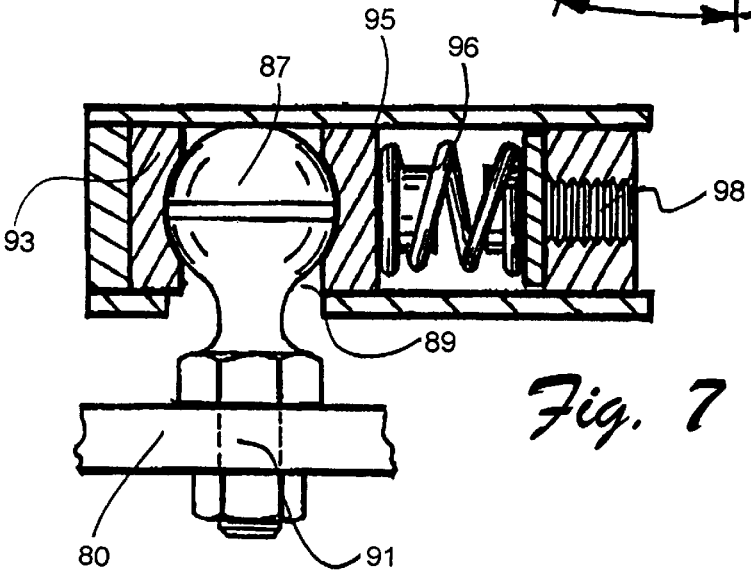

As illustrated in FIGS. 5 through 7, the preferred embodiment of the present invention also provides a means for allowing a user to engage in the manipulation of the pendulum bar 80 against a certain predetermined resistive force. As seen in the figures, a greater degree flexibility and additional resistance could be provided by the ball and socket joint 82 which would have a ball portion 87 supported in a socket portion 89. The ball and socket joint 82 would be positioned on the end of a flexible member 72, and the pendulum bar 80 would be secured to the ball 82 via a nut and bolt connection 91. As illustrated, the socket portion 89 also provides a means for engaging the ball portion 87 within the socket portion 89 with a predetermined amount of force applied against the ball portion 87 by the walls 93, 95 of the socket portion 89. This means includes a spring member 96 provided in one portion of the socket portion 89 with the spring member 96 imparting a certain force against one wall 95 of the socket portion 89 so as to impart a certain amount of force against the ball 87. The second end of the spring member 96 would be engaged to a threaded member 98 so that upon threading the member 98 further into the socket portion 89, the spring 96 imparts added force against the ball member 87. In doing so, the pendulum bar 80, which is suspended from the ball member 87, requires a greater force to manipulate it. Therefore, the person exercising, depending on the amount of engagement of the threaded member, undertakes the exercise at a predetermined measure of force. In doing so, the bar, could be manipulated freely in the socket joint 89, or, depending on the amount that the threaded member is tightened, could be manipulated against the resistive force imparted by the socket joint 89 against the ball 87. For purposes of construction materials, it is foreseen that the walls 93, 95 of the socket 89 would be made of a TEFLON™-like material, which would be very durable, yet offer a certain amount of resistance when pressed against the wall of the ball 87. The ball joint 87,89 is optional and is not essential to the operation of the invention.

Figure 12:
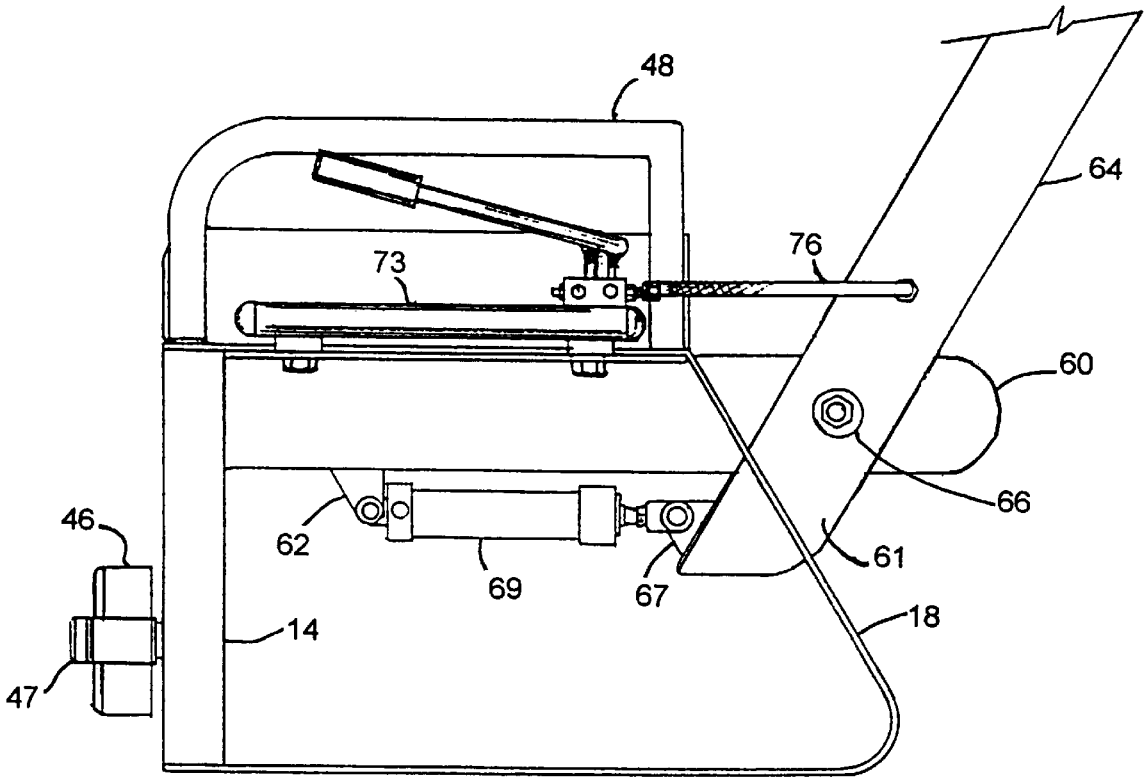
FIG. 12 illustrates a front elevation of the present invention showing the location and mounting of the optional hydraulic hand pump.
Figure 13:
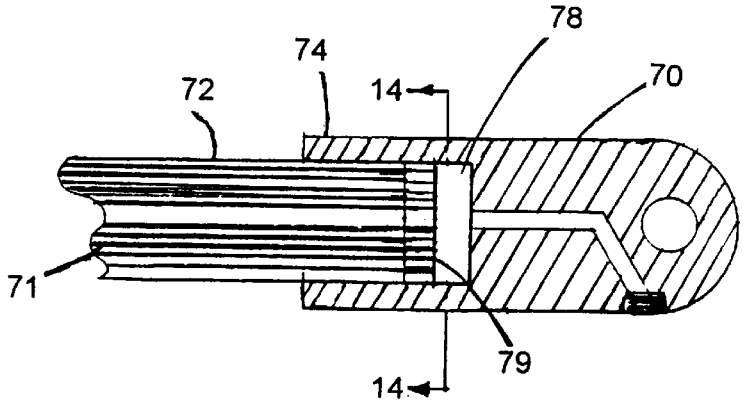
FIG. 13 illustrates a partial cross section view of the horizontal support member and the flexible member taken along section line 12—12 in FIG. 11, showing the hydraulic passage, the manifold cavity and the internal arteries within the flexible member.
Figure 14:
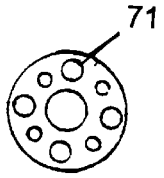
FIG. 14 illustrates a partial section view of the arrangement of the internal arteries taken along section line 13—13 in section FIG. 12.

Another embodiment, as illustrated by FIGS. 10 & 11 contains a unique concept approach to exercise machines. "Variable flexibility" as defined in this concept utilizes a plurality of internal arteries 71, as seen in FIGS. 12 & 13, located within the flexible member 72 which can be made rigid by the introduction of pressurized fluid into the arteries 71 . This is accomplished by pumping the hand pump 73, thereby forcing fluid through a hose 76 passing through the vertical post member 64 to the containment housing 74 where it is distributed by a manifold 79 to the various arteries 71. In this manner the flexibility of the flexible member 72 can be adjusted to the desired degree of flexibility and rotatability. It is foreseen that the shape and size of the flexible member 72 and its internal arteries 71 can be varied to accomplish the desired result. Further selectively opening or closing of the arteries 71 can also affect the flexability of all or portions the flexable member 72 in a significant manner.

It has been found through certain testing of the instant invention that part of the novelty lies in the fact that one may sit upon the cushioned seat 40 of the apparatus 10, grasp the pendulum bar 80, and undertake numerous exercise routines while seated, without the need for heavy weights or stretchable members that would normally be associated with this type of equipment. The friction developed during exercise, while seated, by simply manipulating the free pendulum bar 80 creates sufficient work for the stomach, hip and buttock muscles so that these sets of muscles are the first to be toned, and weight loss in these regions is the most pronounced. If, however, one wanted additional exertion while exercising then the ball and socket joint 82 or the optional, variable flexible member 72 could be adjusted to create greater friction in maneuvering the pendulum bar 80, and thus utilize more energy in exercising. With this apparatus, therefore, a physically challenged person, who may not be able to manipulate weights, is able to comfortably undergo exercise routines with the supported pendulum bar 80 and derive significant benefits in muscle tone and weight loss while never having to manipulate heavy weights.

Figure 15:
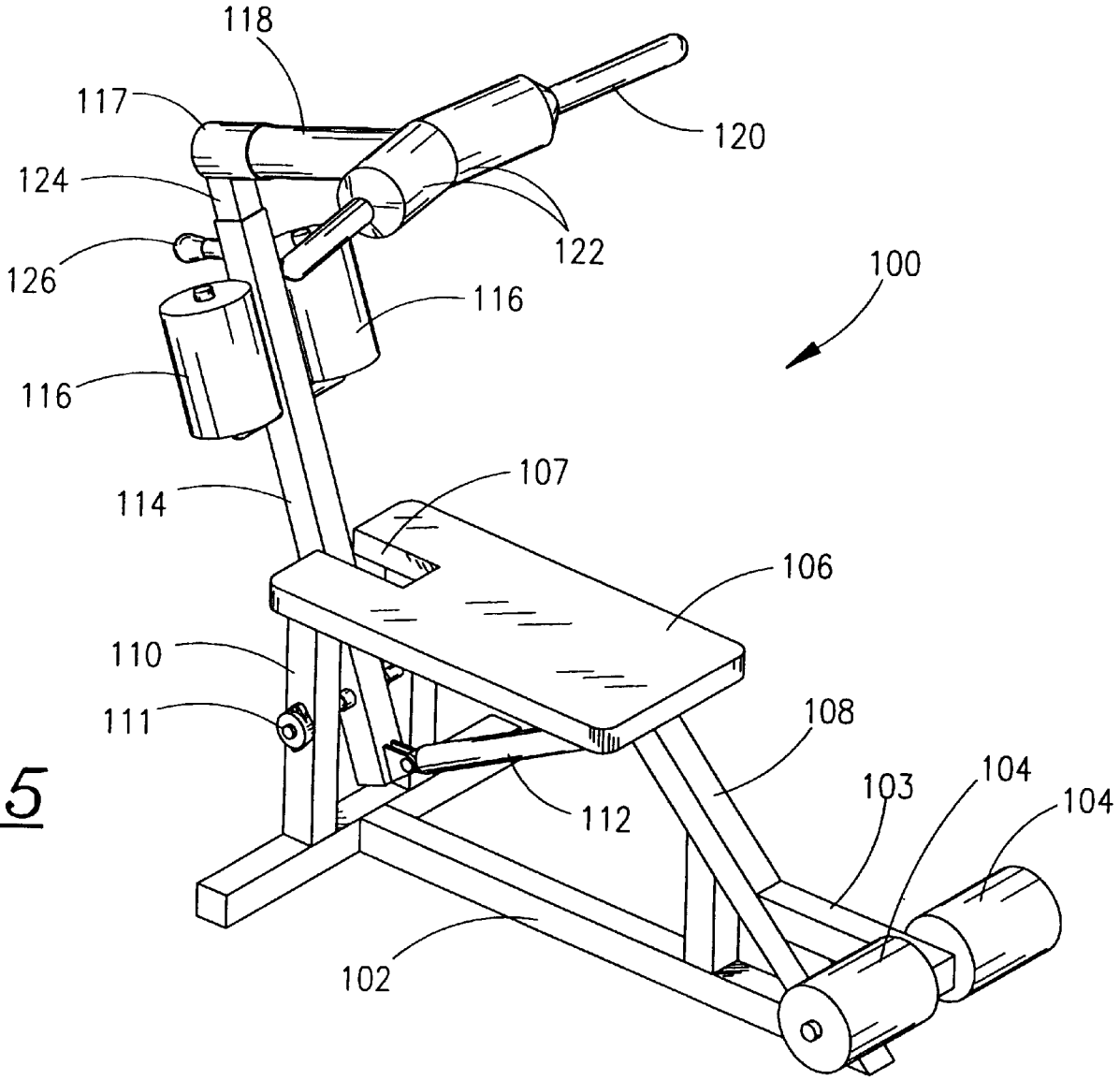
FIG.15 illustrates an isometric view of a second embodiment of the non-medical exercise apparatus having height adjustable vertical post.
Figure 16:
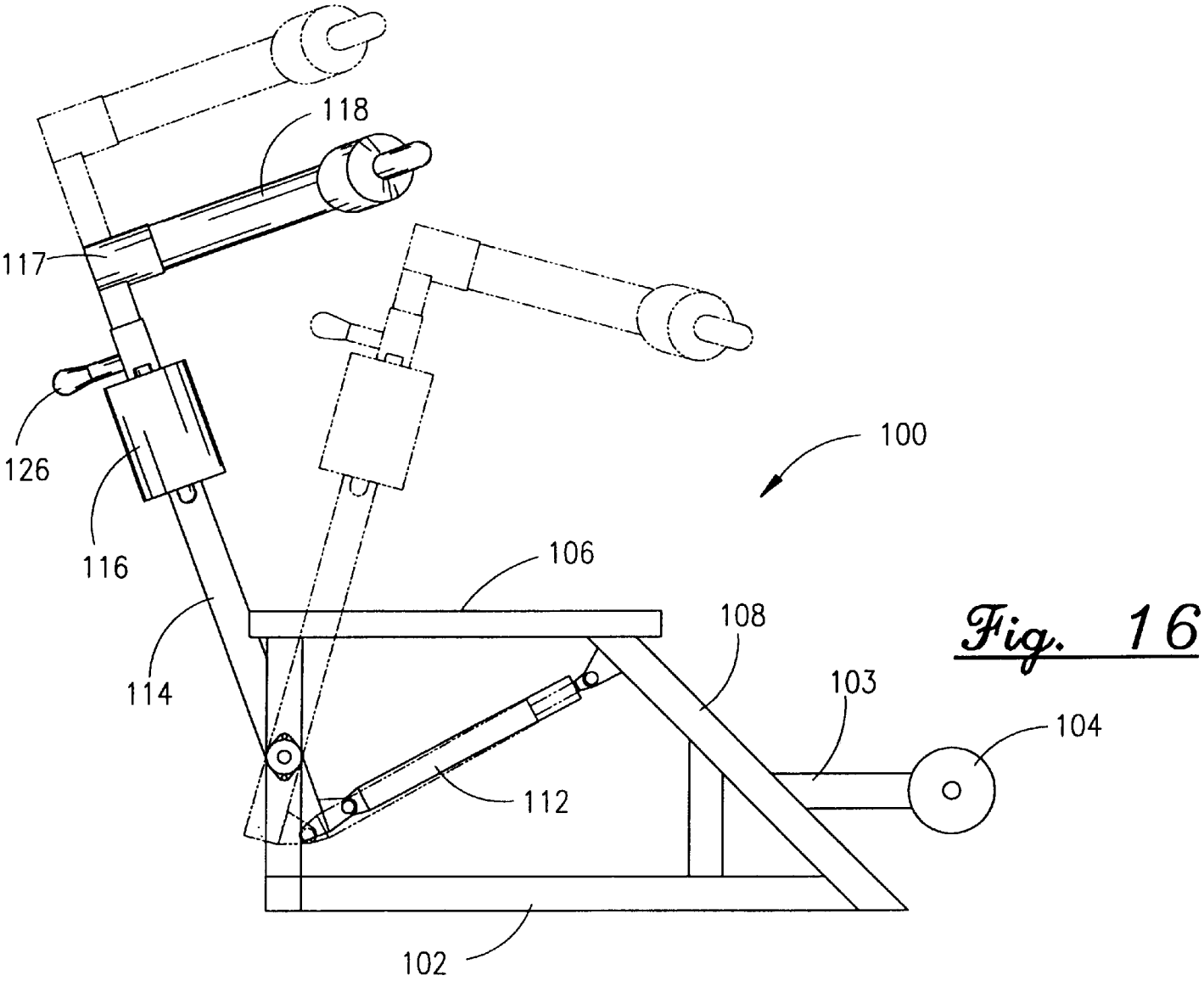
FIG. 16 is a side elevation view or the embodiment shown in FIG. 15 and illustrates the adjustability of the vertical post.

A second embodiment 100, illustrated in FIGS. 15 & 16, shows a non-medical, non-professional model for abdominal exercise. This model comprises a T-shaped base frame 102; padded foot bars attached to the extension member 103 extending forward from the base frame 102; a rectangular seat 106 having a slot 107 attached to the support members 108 and 110 which extend above the T-base frame 102; a vertical post 114 pivotally attached via bearings 111 to the seat support members 110; a shock absorber 112 having variable control and spring return capability attached at one end to the seat support member 108 and at the opposite end to a lower portion of the vertical post 114 thus serving to dampen the return movement and retract the vertical post 114 to its rear most position; a pair of padded back rests 116 attached to the vertical post; an elongated flexible polymeric member 118 secured at one end to the upper most end 117 of the vertical post 114; a pendulum bar 120 secured to the opposite end of the flexible polymeric member 118; and neck pads 122 mounted along the mid-section of the pendulum bar. This embodiment also comprises a telescopically extendable vertical post 114 which is adjustable by extending the upper portion 124 as a result of releasing the spring loaded pull pin 126 thus allowing the pendulum bar 120 to be adjusted to the most comfortable working height for the user.

Figure 17:
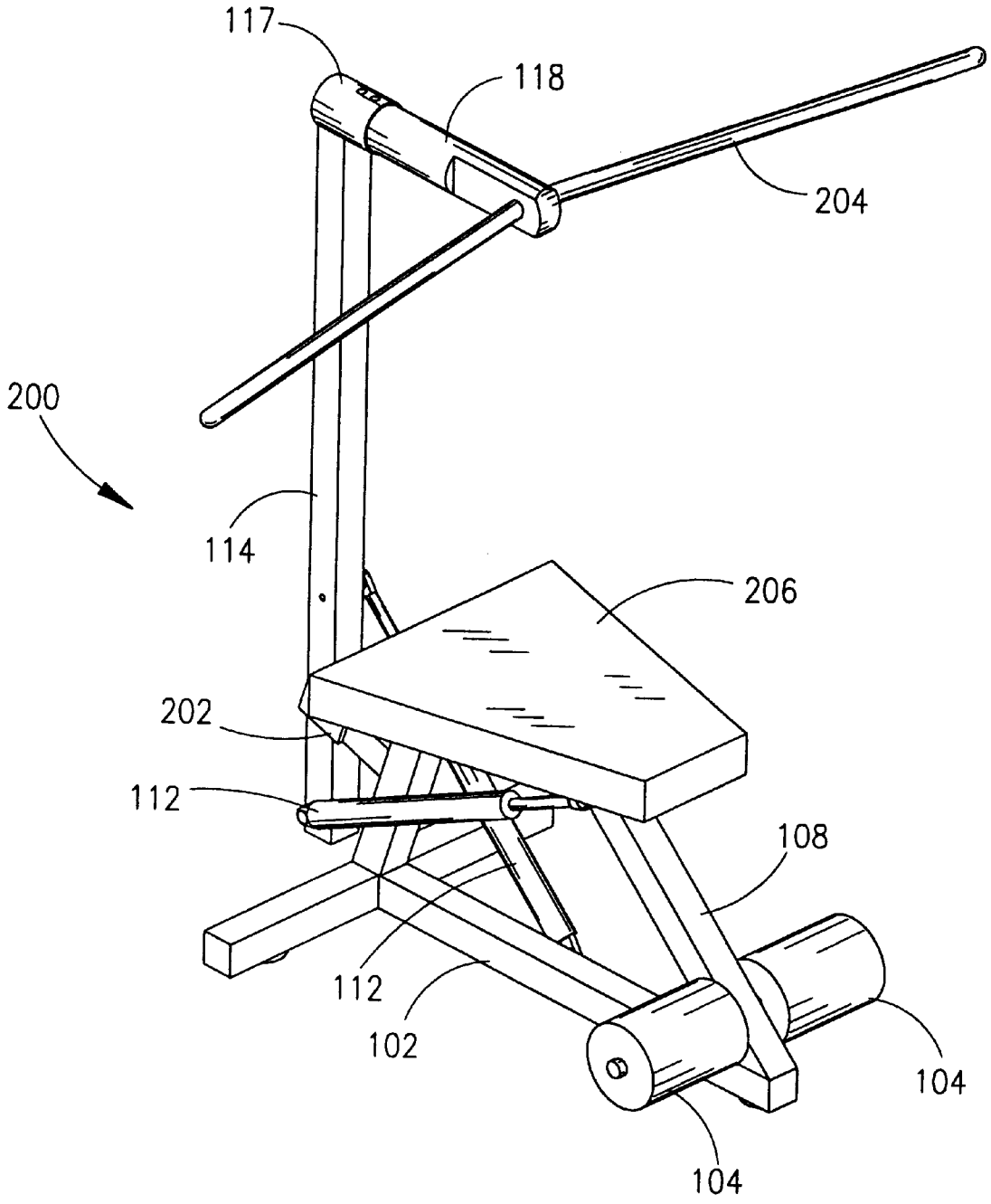
FIG. 17 is an isometric view of a third embodiment without vertical post adjustment .
Figure 18:
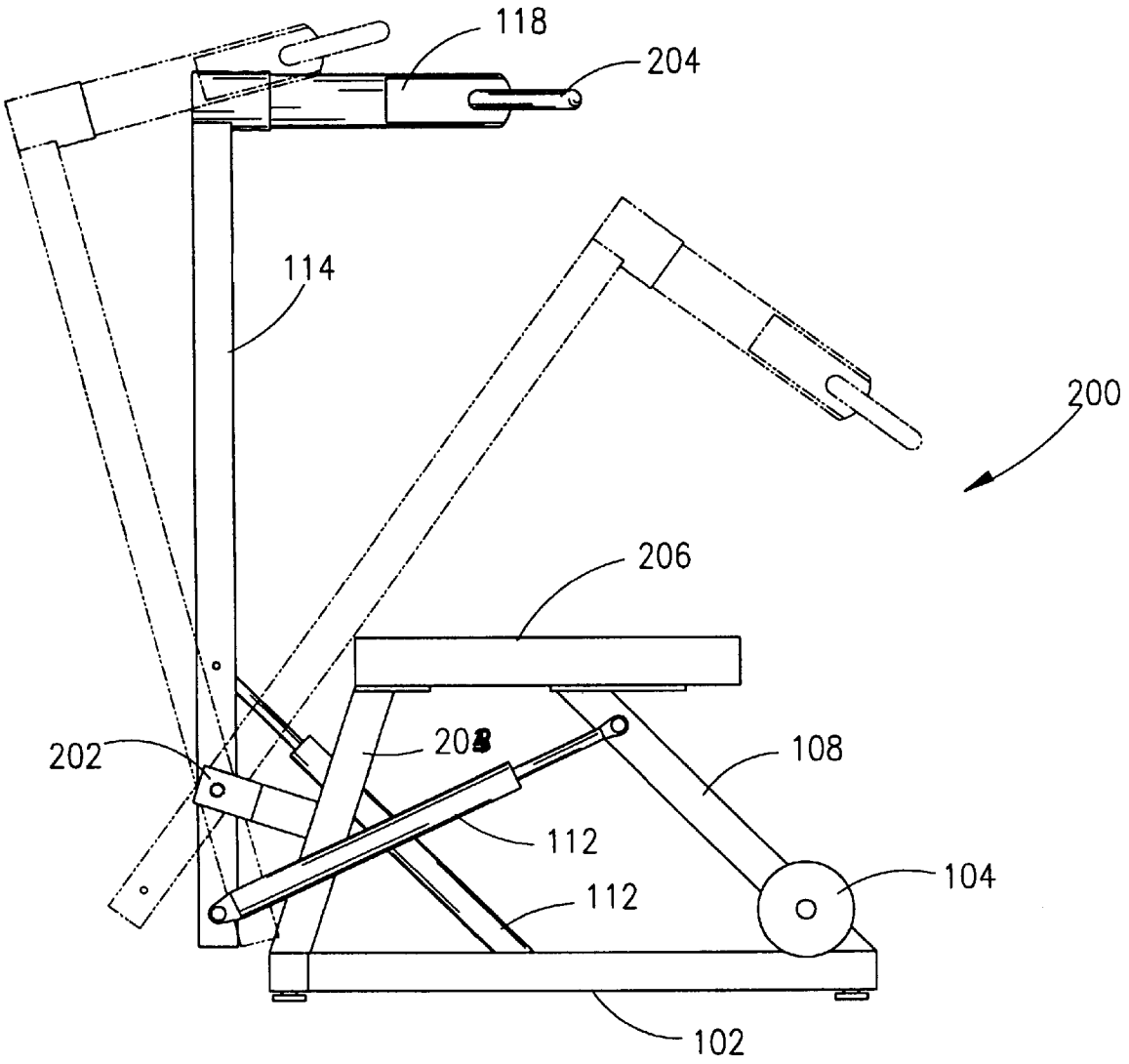
FIG. 18 is a side elevation of the third embodiment shown in FIG. 17 illustrating a method of shock damping for the vertical post.
Figure 21:
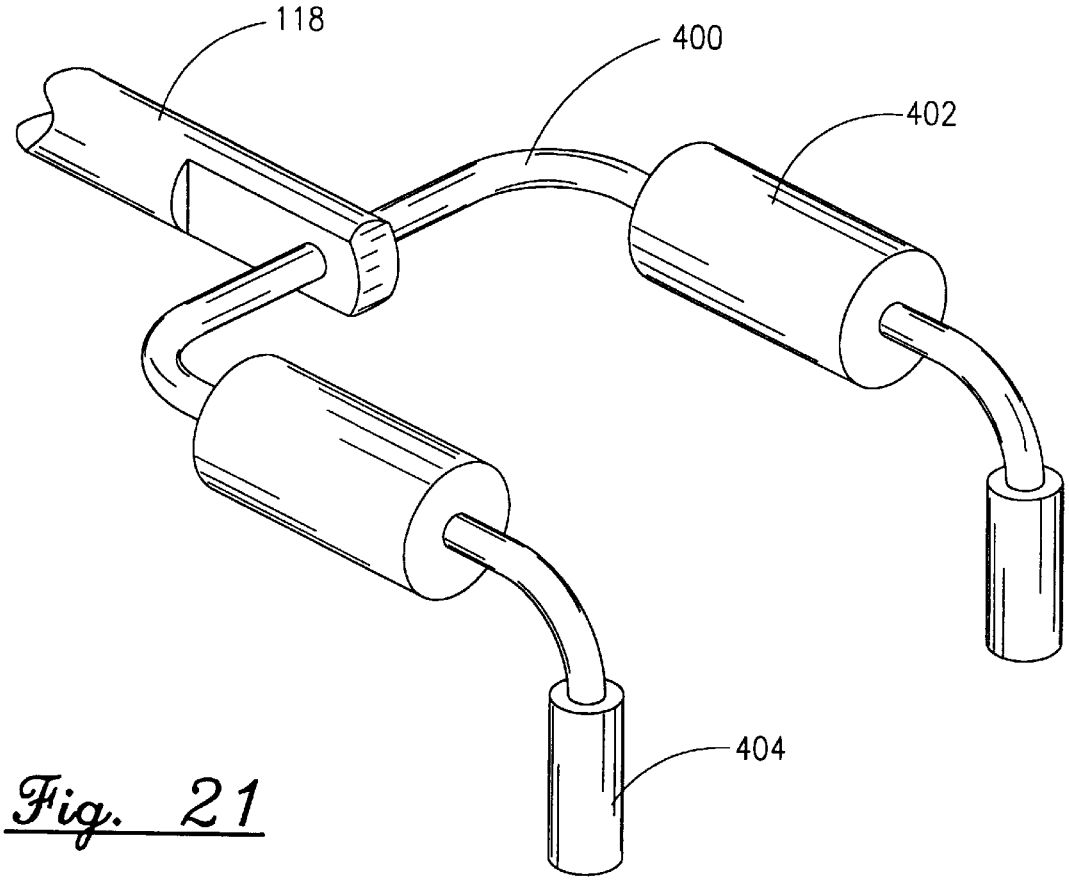
FIG. 21 illustrates an alternative embodiment of the pendulum bar.

A third model, designed for individual or home use, is shown in FIGS. 17 & 18. This model, although similar to that of FIGS. 15 and 16 can be tailored to a particular user or specific needs. This model still uses some parts from the Model 100 such as the base frame 102, the seat support 108, the padded foot bar 104, the vertical post member 114, and the shock absorber 112. However, variations are made with regard to the pivotal mounting of the vertical post 114. The post 114 in this case is simply mounted to a clevis bracket 202 and attached to the rear seat member 203 which extends upwards from the base frame 102. We also see that the vertical post member 114 is not telescopic in this case but could be if desired. Any number of pendelum bars 204 can be used as desired, including the bar shown in FIG. 21 in which the pendulum bar 400 is bent in a manner that allows the user to grip the bar by the grips 404 in front of his body with the neck pads 402 resting on the user's shoulders. Dual adjustable shock absorbers 112 are illustrated to indicate that damping action may be desired in both directions. In this case one shock would then be providing additional resistance to the user when doing forward waist bends. A special triangular seat 206 which reduces chaffing of the inner thigh is supplied with this model.

Figure 19:
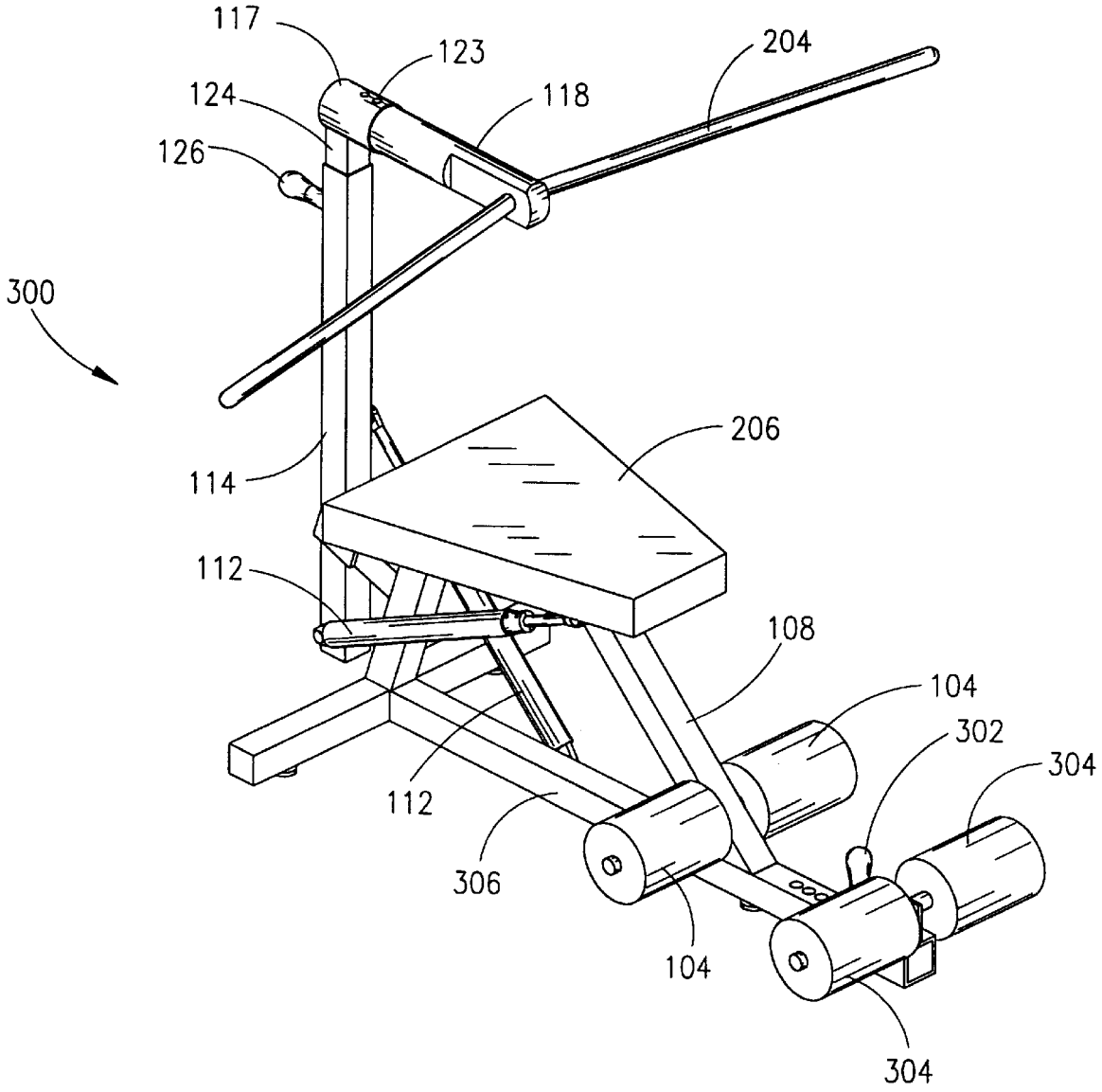
FIG. 19 is an isometric view of a forth embodiment having adjustable foot supports, vertical post adjustment and dual shock damping.
Figure 20:
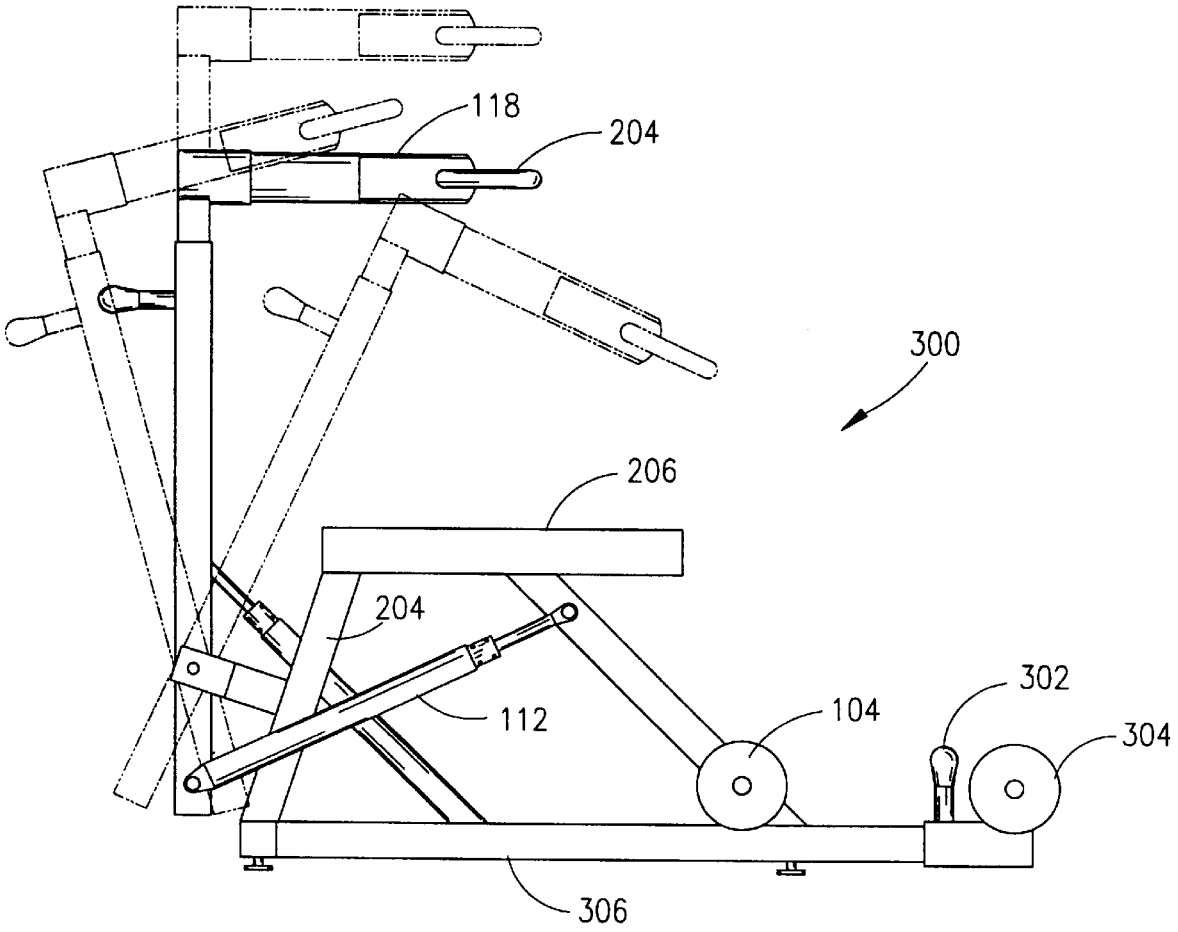
FIG. 20 is a side elevation of the forth embodiment shown in FIG. 19 illustrating vertical post extension and shock damping action.

A fourth model 300 or professional model such as would be used in gyms etc. is illustrated in FIGS. 19 & 20. This model combines components of model 100 and model 300 and adds the adjustable vertical post member 114 and a second set of padded foot bars 304. This second set of padded foot bars 304 is adjustable via a spring loaded pull pin 302 to allow for more comfortable adaptation to multiple users. As a result of the extendable foot bars 304 a longer base frame is required.

Various embodiments are disclosed herein which fall within the scope of the inventive concept. It can therefore, be seen that many modifications may be made in the embodiments detailed in accordance with the descriptive drawings associated therewith. It is to be understood that the details described and shown herein are to be interpreted as illustrative and not in any limiting sense.

What is claimed is:

1. An exercise apparatus comprising:

a) a base frame;

b) a vertical member, having an end pivotally attached to said base frame;

c) a clevis, pivotally attached to said vertical member at end apposite said base frame;

d) an elongated, semi-flexible polymeric member having an end attached to said clevis; and e) a means attached to said semi-flexible polymeric member opposite said clevis for grasping by a user to distort said semi-flexible polymeric member in at least two planes.

2. An exercise apparatus according to claim 1, wherein said semi-flexible polymeric member is a resilient material selected from the group consisting of elastomers, and polymers.

3. An exercise apparatus according to claim 2, wherein said semi-flexible polymeric member is capable of being simultaneously distorted in a plurality of planes.

4. An exercise apparatus according to claim 3, wherein distortion of said semi-flexible polymeric member is by direct manipulation by a user.

5. An abdominal muscle toning apparatus comprising:

a) a base frame;

b) a seat secured to said base frame;

c) a pivotal stanchion having one end pivotally attached to said base frame;

d) a clevis pivotally attached to an end of said stanchion opposite said base frame;

e) an elongated, polymeric member having one end attached to said clevis; and f) a means attached to said semi-flexible polymeric member opposite said clevis for grasping by a user to distort said semi-flexible polymeric member in at least two planes.

6. An abdominal muscle toning apparatus according to claim 5 wherein said apparatus further comprises a biased, deceleration means connected to said pivotal stanchion and said base frame, for controlling rate of retraction of said stanchion, from a first extended position to a second retracted position, due to said bias.

7. An exercise apparatus comprising:

a) a base;

b) a seat supported by said base;

c) a vertical stanchion having upper and lower ends, said lower end pivotally attached to said base;

d) an elongated, semi-flexible polymeric member having two ends, one end of which is pivotally secured to said said stanchion upper end; and e) a means attached perpendicularly to said elongated, semi-flexible polymeric member at an end opposite said vertical stanchion, for allowing a user to grasp and manipulate said semi-flexible polymeric member in at least two planes.

8. An exercise apparatus according to claim 7, wherein said vertical stanchion has retracted and forward positions and means by which it is biased towards said retracted position and further comprises a variable, damping means for controlling rate of travel from said forward position to said retracted position.

9. An exercise apparatus according to claim 8, further comprising means for variably controlling said rate of travel between said retraced position to said forward position.

10. An exercise apparatus according to claim 7, wherein said base further comprises at least one set of padded ankle bars.

11. An exercise apparatus comprising:

a) a base frame portion;

b) a seat portion attached to said base frame;

c) a vertical stanchion having upper and lower ends said lower end pivotally attached to said base frame, adjacent said seat;

d) an elongated, unitized semi-flexible polymeric member attached at one end to said upper end of said vertical stanchion;

e) a ball and socket joint attached to said elongated unitized semi-flexible polymeric member at an end opposite said stanchion; and f) a means attached to said ball and socket joint for allowing a user to grasp and manipulate said elongated semi-flexible polymeric member in at least two planes simultaneously.

12. An exercise apparatus in accordance with claim 11, wherein said base frame portion is comprised of three interconnected leg members.

13. An exercise apparatus in accordance with claim 11, wherein said seat portion further comprises;

a) a padded cushion;

b) at least one hand rail adjacent said seat portion; and c) a seat belt attached to said base frame portion.

14. An exercise apparatus in accordance with claim 13, wherein said apparatus further comprises a vertical back rest portion attached to said base frame portion, adjacent to said seat portion.

15. An exercise apparatus in accordance with claim 11, wherein said apparatus further comprises a calf muscle pad having an ankle belt associated therewith attached to said base frame portion below said seat portion.

16. An exercise apparatus in accordance with claim 15, wherein said apparatus further comprises an angular foot plate attached to said base frame below and adjacent said calf muscle pad.

17. An exercise apparatus in accordance with claim 11, wherein said elongated semi-flexible polymeric member is comprised of a resilient material selected from the group consisting of elastomers, and polymers.

18. An exercise apparatus in accordance with claim 11, further comprising a means for controlling the range of pivotal motion between said vertical stanchion and said elongated semi-flexible polymeric member.

19. An exercise apparatus comprising:

a) a frame;

b) an elongated semi-flexible polymeric member;

c) a means for attaching said semi-flexible polymeric member to said frame;

d) a means attached to said semi-flexible polymeric member for grasping by a user to manipulate said semi-flexible polymeric member in at least two planes simultaneously; and e) a means for hydraulically controlling rigidity of said semi-flexible polymeric member.

20. An exercise apparatus according to claim 19, wherein said means for hydraulically controlling rigidity is a fluid pressurizing system connected to said semi-flexible member.

21. An exercise apparatus according to claim 20, wherein said pressurizing system further comprises:

a) a plurality of passages located longitudinally within said semi-flexible polymeric member;

b) a manifold, selectively communicative with said passages attached to said semi-flexible polymeric member;

c) a pump means for applying pressure to said fluid pressuring system and fluid located within said passages;

d) tubing means for connecting said manifold to said pump means; and e) a means for releasing the pressure on said fluid produced by said pump means.

22. An exercise apparatus according to claim 20, wherein said means for controlling rigidity further comprises:

a) passages located longitudinally within said unitized semi-flexible polymeric member;

b) a manifold, selectively communicative with said passages attached to at least one end of said semi-flexible polymeric member;

c) a pump means for applying pressure to said passages;

d) tubing means for connecting said manifold to said pump means;

e) a means for releasing said pressure applied by said pump means.

23. An exercise apparatus for use by physically challenged individuals, the apparatus comprising:

a) a base frame having a plurality of legs;

b) a seat, secured to said base frame;

c) a seat belt attached to said seat;

d) a vertical post member having upper and lower ends and forward and retracted positions located behind said seat, pivotally attached to said base frame;

e) a unitized semi-flexible polymeric member attached to said upper end of said vertical post member in a manner whereby said polymeric member is positioned parallel to and above said seat;

f) a means, attached to said semi-flexible polymeric member, located opposite said vertical post member for grasping by a user to manipulate said unitized semi-flexible polymeric member in at least two planes simultaneously;

g) a biasing means for returning said vertical post to said retracted position;

h) a variable damping means for controlling rate of retraction of said vertical post from said forward position to said retracted position; and i) a means for hydraulically controlling rigidity of said semi-flexible polymeric member in a manner which provides a predetermined resistive force against free movement of said semi-flexible polymeric member.

24. The exercise apparatus according to claim 23, wherein there is further provided a vertical back rest located behind said seat.

25. The exercise apparatus according to claim 24, wherein there is further provided a hand rail adjacent said seat to assist said physically challenged individuals traverse between said seat and a wheel chair.

26. The exercise apparatus according to claim 23, wherein said exercise apparatus further comprises a ball and socket means located between said means for grasping and said semi-flexible polymeric member for increasing flexibility of said semi-flexible polymeric member.

27. The exercise apparatus according to claim 23, wherein said biasing means, for resisting the movement of said vertical post member from said retracted position to forward extended position, is a variable "gas cylinder" having integral biasing and damping means said damping means for restricting rate of travel from said forward extended position to said retracted position.

28. The exercise apparatus in claim 23, further comprising a calf pad, a foot plate and a strap means for securing said physically challenged individual's legs to said base frame.

29. The exercise apparatus in claim 23, further comprising hand grip members positioned midway along each side of said vertical post, for grasping by a user doing curling exercise routines while straddling and facing said vertical post.

30. An exercise apparatus according to claim 23, wherein said rigidity control means is a fluid pressurizing system.

31. A method of exercising, comprising the steps of:

a) providing an exercise apparatus comprising:

i) a frame;

ii) an elongated semi-flexible polymeric member having distal and proximate ends;

iii) a mounting means for attaching said distal end of said semi-flexible polymeric member to said frame; and iv) a means attached to said proximate end of said semi-flexible polymeric member opposite said mounting means for grasping by a user to manipulate said semi-flexible polymeric member;

b) configuring said apparatus with a said semi-flexible polymeric member to meet rigidity and flexibility requirements for a specific exercise regimen according to material, flexibility, size and shape; and c) manipulating said semi-flexible polymeric member via a user, distorting and bending said semi-flexible polymeric member in at least two planes without the use of cables and free weights;

d) hydraulically controlling the rigidity of said semi-flexible polymeric member.

32. A method of exercise according to claim 31, wherein said steps further includes manipulating said lever and said semi-flexible polymeric member in such a manner so as to achieve muscle tone and weight loss to the buttocks, waistline, and hips of a user during trunk twist and side bend exercise routines.

33. The method according to claim 31, wherein said apparatus further includes means for controlling rigidity of said semi-flexible polymeric member.

34. A method of exercising, comprising the steps of:

a) providing an exercise apparatus comprising:

i) a frame having a seat attached thereto;

ii) an elongated semi-flexible polymeric member having distal and proximate ends;

iii) a mounting means for rigidly attaching said distal end of said semi-flexible member to said frame;

iv) a means attached to said proximate end of said semi-flexible polymeric member opposite said mounting means, for grasping by a user to bend and distort said semi-flexible polymeric member in at least two planes simultaneously; and v) a means for hydraulically controlling rigidity and flexibility of said semi-flexible member;

b) adjusting said means for controlling rigidity and flexibility to meet rigidity and flexibility requirements for a specific exercise regimen; and c) manipulating said leverage means in a manner whereby said semi-flexible polymeric member is flexed and distorted in at least two planes without the use of cables and free weights.

35. A method of exercise according to claim 34, wherein a portion of said elongated semi-flexible polymeric member and said leverage means is fitted with a ball and socket joint having variable resistance means for providing additional controllable resistive force to said semi-flexible polymeric member during exercise.

36. A method of exercise for toning the abdominal muscles using a resistance apparatus according to claim 34 wherein said apparatus, having a semi-flexible polymeric member as a primary means of resistance and whereby said semi-flexible polymeric member is manipulated, by a user, in a distorting manner in multiple planes via said means for grasping, includes a further method of exercise comprising the steps of:

a) assuming a seated position upon said apparatus;

b) positioning said semi-flexible polymeric member and leverage means relative said user's neck and shoulders in a prescribed manner;

c) manipulating said means for grasping and said semi-flexible member by bending and rotating said user's upper body trunk thus distorting said semi-flexible polymeric member in at least two planes;

d) returning said semi-flexible polymeric member to a relaxed non-distorted position; and e) repeating said exercise routine alternately distorting and relaxing said semi-flexible polymeric member.

37. The method of exercise according to claim 36 wherein said semi-flexible polymeric member is elastic when bent in combination with rotary distortion.

38. A method of exercise comprising the steps of:

a) providing an exercise apparatus comprising:

i) a base frame;

ii) an elongated unitized semi-flexible polymeric member;

iii) a mounting means for rigidly attaching a portion of said semi-flexible polymeric member to said frame;

iv) a means attached to said semi-flexible polmeric member opposite said mounting means, for grasping by a user, to bend and distort said semi-flexible polymeric member in at least two planes simultaneously; and v) a means for controlling rigidity of said semi-flexible polymeric member;

b) pressurizing a plurality of passages disposed within said unitized semi-flexible polymeric member thereby rigidizing said polymeric member as necessary for a specific exercise regimen; and c) manipulating said semi-flexible polymeric member without the use of cables and free weights.

* * * * *